US006238056B1

(12) United States Patent
Rapisarda

(10) Patent No.: US 6,238,056 B1
(45) Date of Patent: May 29, 2001

(54) SPRING MOUNTED LIGHT

(76) Inventor: Carmen C. Rapisarda, 21211 Wisteria St., Apple Valley, CA (US) 92308

( * ) Notice: Subject to any disclaimer, the term of this patent is extended or adjusted under 35 U.S.C. 154(b) by 0 days.

(21) Appl. No.: 09/392,535

(22) Filed: Sep. 9, 1999

(51) Int. Cl.[7] ..... F21L 11/00; A43B 23/00

(52) U.S. Cl. ..... 362/103; 362/276; 362/802; 362/394; 36/137

(58) Field of Search ..... 362/394, 103, 362/800, 276, 802, 464, 493, 496; 200/61.48, 61.49, 61.51; 36/137

(56) References Cited

U.S. PATENT DOCUMENTS

| | | | | |
|---|---|---|---|---|
| 4,848,009 | | 7/1989 | Rodgers . | |
| 5,408,764 | | 4/1995 | Wut . | |
| 5,419,061 | | 5/1995 | Barrocas . | |
| 5,430,621 | | 7/1995 | Raskas . | |
| 5,465,197 | * | 11/1995 | Chien | 362/802 |
| 5,477,435 | | 12/1995 | Rapisarda . | |
| 5,490,338 | | 2/1996 | Hwang et al. . | |
| 5,550,721 | * | 8/1996 | Rapisarada | 362/802 |
| 5,595,437 | * | 1/1997 | Rapisarda et al. | 362/109 |
| 5,644,858 | | 7/1997 | Bemis . | |
| 5,707,136 | * | 1/1998 | Byers | 362/145 |
| 5,732,486 | | 3/1998 | Rapisarda . | |

* cited by examiner

*Primary Examiner*—Thomas M. Sember
(74) *Attorney, Agent, or Firm*—Edgar W. Averill, Jr.

(57) ABSTRACT

A light module, including a battery, which is connected to one or two electrically conductive springs which support an LED at their outer end. The LED, when moved and lighted, provides an attractive moving light. Such module is useful in shoes where the movement of the walker moves the LED. The LED is especially effective when energized by a motion sensitive switch.

13 Claims, 1 Drawing Sheet

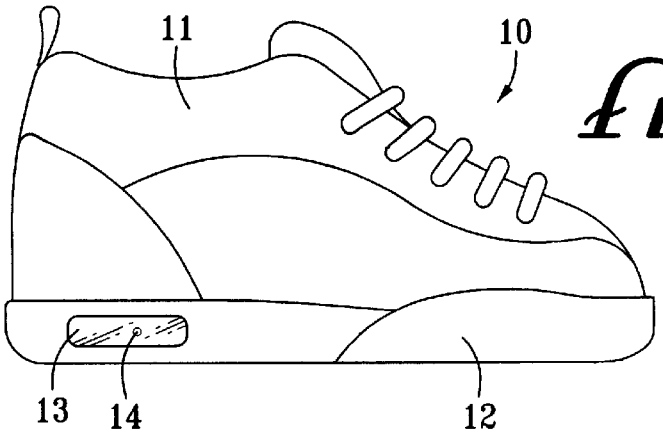
FIG. 1
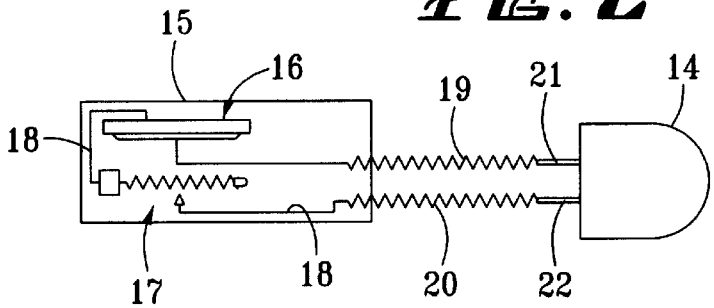
FIG. 2
FIG. 3
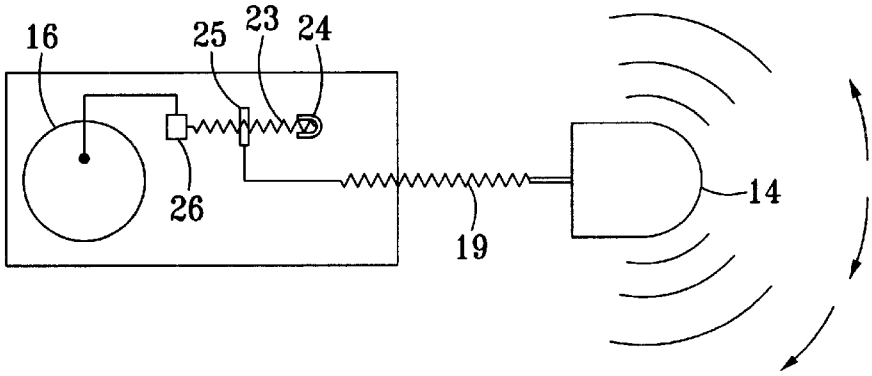
FIG. 4
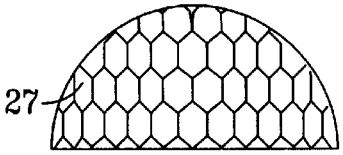
FIG. 5
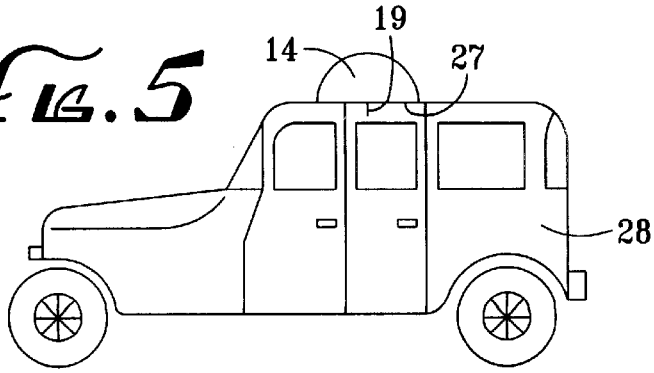

SPRING MOUNTED LIGHT

BACKGROUND OF THE INVENTION

The field of the invention is lighted articles and the invention relates more particularly to devices which include footwear, toys and novelty items having a battery and a switch held by the device and which intermittently, either by motion or by an electric circuit, cause the light in the device to blink on and off or to stay on. Such devices have enjoyed widespread commercial success in footwear. One of the earlier designs is shown in applicant's U.S. Pat. No. 5,732,486. Other lighted footwear is shown in U.S. Pat. Nos. 4,848,009; 5,408,764; 5,419,061; 5,430,621; 5,490,338; 5,644,858; and 5,477,435.

The most popular lighted shoes utilize one or more LEDs turned on and off by a motion sensitive switch. Typically, such LEDs are mounted behind a transparent or translucent window in the sole or upper portion of the shoe, and there is always a desire to provide a more spectacular and attention-getting lighting system.

BRIEF SUMMARY OF THE INVENTION

It is an object of the present invention to provide a light module useful in toys, clothing or footwear which light moves as the object in which it is mounted moves.

The present invention is for a light module having a battery. At least one electrically conductive spring is electrically connected to one terminal of the battery and LED or other light source is electrically connected to the other end of the spring. The second terminal of the light and the second terminal of the battery are connected by a second flexible conductor which is preferably a second electrically conductive spring. Alternatively, a light is mechanically connected to a spring which is not electrically conductive and the light is ngaged by a pair of highly flexible wires. Preferably, a motion sensitive switch is added to the circuit so that when the assembly is placed in the heel of a shoe or in the body of a toy and the wearer is walking or the toy is being moved, the light is not only blinking on and off from the motion sensitive switch, but the lamp is also moving.

BRIEF DESCRIPTION OF THE DRAWINGS

FIG. 1 is a side view of a shoe containing the module of the present invention in the sole thereof.

FIG. 2 is a side view partly in cross-section of the module of the present invention.

FIG. 3 is a top view of the module of FIG. 2.

FIG. 4 is a side view of a faceted lens placed in front of the LED of FIG. 2.

FIG. 5 is a side view of a toy motor vehicle containing the module of the present invention.

DESCRIPTION OF THE PREFERRED EMBODIMENTS

A shoe is shown in FIG. 1 and indicated generally by reference character 10. Shoe 10 has an upper 11 and a sole 12. A hollow cavity is formed in sole 12 similar to that shown in U.S. Pat. No. 5,732,486, which is incorporated by reference herein for background purposes. A clear window 13, which is preferably clear polyvinyl chloride, is sealed in the sole of the shoe and behind this is indicated a moving LED 14. While LED 14 is shown in the sole of the shoe, it can, of course, be positioned in a pocket in the upper portion of the shoe and it can, of course, be at the toe, the heel, or any place around the sole. It can, of course, alternatively be positioned in another device such as a toy or a novelty item.

The module itself is shown in side view in FIG. 2 where a waterproof box 15 contains a battery 16. A motion sensitive switch is generally indicated by reference character 17. A first conductor 18 is connected through motion sensitive switch 17 to LED 14. A pair of helical springs 19 and 20 hold the LED 14 in a cantilevered manner. Springs 19 and 20 are electrically conductive and are soldered or otherwise electrically connected to leads 21 and 22 of LED 14. LED 14 might be a surface mount LED to minimize size and weight.

As the result of the mounting of LED 14 at the end of two flexible helical springs, and including a motion sensitive switch in the circuit, when a wearer of the shoe walks, the circuit is completed intermittently as the result of switch 17, while at the same time, the LED is moving up/down and backwards/forward. The effect is very surprising and attention-getting.

The module of FIG. 2 is shown in top view in FIG. 3 where the motion sensitive switch can be seen to have a spring 23 with a weight 24 at its end. An electrical contact 25 is located intermediate between a spring support 26 and weight 24.

While two helical springs are shown in FIGS. 1 and 2, it is also contemplated that LED 14 be supported by a single helical spring on one of the leads, such as lead 21, and a flexible conductor, such as a small diameter wire, be used in place of helical spring 20. Alternatively, in place of a helical spring, a thin conductive whisker could be used in place of the helical springs. A further option is the suporting of the LED or other lamp on a con-conducting spring and providing highly flexible wires to the lamp so that the wires do not restrict movement of the lamp.

It has also been found that an exceptionally spectacular appearance results when an optically distorted lens such as a faceted lens is used for the clear window 13. The movement and the blinking on and off of the LED behind the faceted lens provides a very attractive appearance. While one LED is shown in the drawings, it is, of course, possible that two or more lamps can be spring supported by box 15. It is also preferable, although not essential, that two springs be used, with one spring being mounted above the other when the LED is mounted in an elongated window, such as that shown in FIG. 1 of the drawings. In this way, the motion of the switch along the window is enhanced and the up and down motion, while still present, is lessened.

A toy truck 28 is shown in FIG. 5 supporting the module of FIGS. 2 and 3 therein. A faceted dome 27 is mounted on top of the truck 28. A moveable LED 14 is supported within faceted dome 27. As the truck 28 is moved, the LED 14 blinks on and off and moved back and forth under dome 27. The module may also be supported in other novelty items such as balls, yo-yos and the like.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A light module supporting a battery, a motion sensitive switch and a lamp said lamp having two terminals, each of said two terminals being electrically connected to said battery and said lamp being supported on a spring so that the lamp moves in a different manner than said light module.

2. The light module of claim 1 wherein said switch is a motion sensitive switch.

3. The light module of claim 1 wherein said lamp is mounted on a pair of electrically conductive springs, said electrically conductive springs being connected to said battery to power said lamp.

4. The light module of claim 3 wherein said switch is a motion sensitive switch.

5. The light module of claim 1 wherein said lamp is an LED.

6. The light module of claim 5 wherein said LED is positioned behind a faceted lens.

7. Footwear having a sole, an upper and a light module held behind a window in the footwear, said light module comprising:

a battery having a first terminal and a second terminal;

at least one electrically conductive spring electrically connected at an inner end to said first terminal of said battery and electrically connected at an outer end to a first terminal of an electric light, said electric light having a second terminal in addition to said first terminal and said electrical light being supported in a cantilevered manner at the outer end of said at least one electrically conductive spring; and a flexible electrical conductor electrically connected between the second terminal of said battery and a second terminal of said electrical light.

8. The footwear of claim 7 wherein said flexible electrical conductor is a second electrically conductive spring.

9. The footwear of claim 8 wherein said electrically conductive springs are helical springs.

10. The footwear of claim 9 wherein said first electrically conductive spring is mounted above and parallel to said second electrically conductive spring.

11. The footwear of claim 7 wherein said electric light is a light emitting diode (LED).

12. The footwear of claim 7 wherein said electrically conductive spring is electrically connected to said at least one electrically conductive spring by a conductive member and an intermittent switch is electrically positioned in said conductive member to intermittently turn on and off said electric light.

13. The footwear of claim 12 wherein said intermittent switch is a motion sensitive switch so that when said module moves, the motion sensitive switch turns on and off and such movement also causes the electric light to move at the end of said at least one electrically conductive spring.

* * * * *